United States Patent [19]

Raymond et al.

[11] Patent Number: 4,715,599

[45] Date of Patent: Dec. 29, 1987

[54] BASKETBALL BACKBOARD FOR A DIVING BOARD

[76] Inventors: Dean Raymond, 124 Manlove Ave., Hightstown, N.J. 08520; John J. Metrosky, R.D. 1, Box 111, Allentown, N.J. 08501

[21] Appl. No.: 873,997

[22] Filed: Jun. 13, 1986

[51] Int. Cl.[4] ..... A63B 63/08

[52] U.S. Cl. ..... 273/15 R; 248/205.1; 248/225.31

[58] Field of Search ..... 273/1.5 R, 1.5 A, 411; 248/205.1, 225.31

[56] References Cited

U.S. PATENT DOCUMENTS

| | | | |
|---|---|---|---|
| Re. 23,339 | 2/1951 | Ducey | 248/225.31 X |
| 2,818,254 | 12/1957 | Dunn | 273/1.5 R |
| 3,269,682 | 8/1966 | Alpine | 248/225.31 |
| 3,469,844 | 9/1969 | Sindelar | 273/1.5 R X |
| 3,582,078 | 6/1971 | Katras | 273/1.5 R X |
| 3,743,286 | 7/1973 | Weinhagen et al. | 273/1.5 R |
| 4,220,337 | 9/1980 | Moore | 273/411 X |
| 4,307,887 | 12/1981 | Weiss | 273/1.5 R X |
| 4,418,883 | 12/1983 | Cohen | 248/205.1 X |
| 4,613,136 | 9/1986 | Raba et al. | 273/1.5 R |

*Primary Examiner*—Paul E. Shapiro

*Attorney, Agent, or Firm*—Richard C. Woodbridge

[57] ABSTRACT

A backboard apparatus having a hoop is attachable to a diving board so that a basketball-like game can be played in the deep end of a swimming pool. The weight of the apparatus is primarily supported by a first horizontal member that extends across the top width of the diving board. A pair of vertical panels attached to the first horizontal member support the backboard. A second horizontal member parallel to and located below the first horizontal member contacts the bottom surface of the diving board when the apparatus is installed. The center of gravity of the apparatus is preferably located between the backboard section and the first horizontal member so that the apparatus has a natural tendency to tilt forward, forcing the second horizontal member up against the bottom surface of the diving board. In this position the diving board will normally overhang the front edge of the diving board. The game apparatus can be easily attached to or removed from a diving board in a matter of seconds.

4 Claims, 9 Drawing Figures

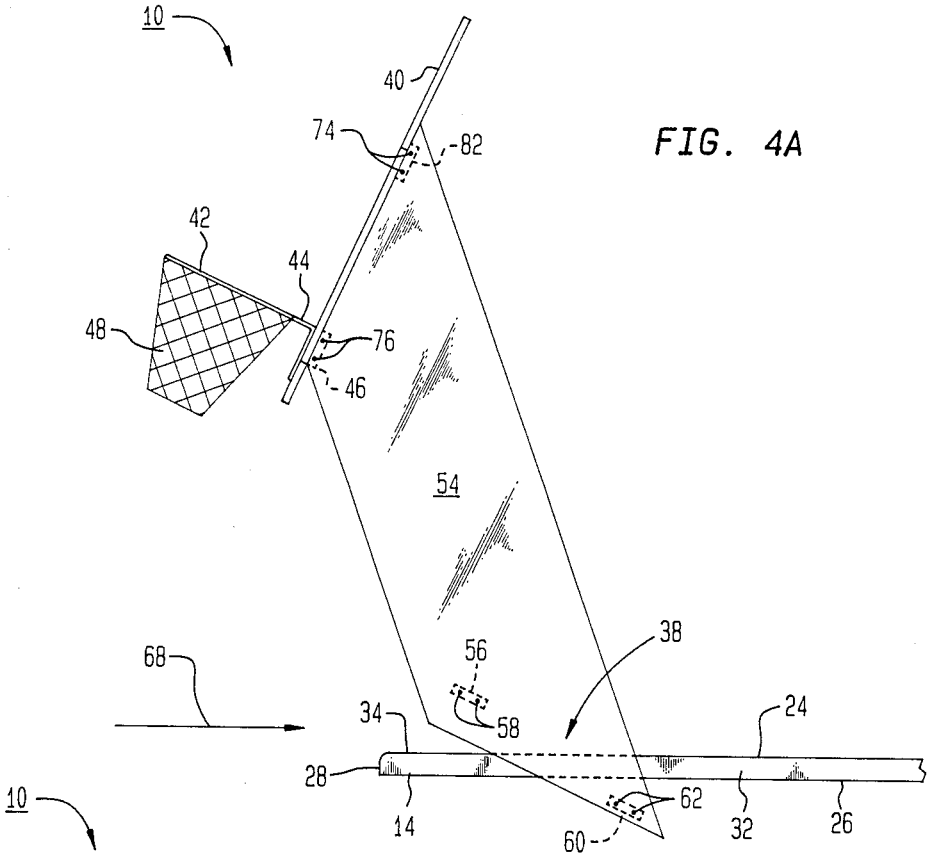
FIG. 4A
FIG. 4B
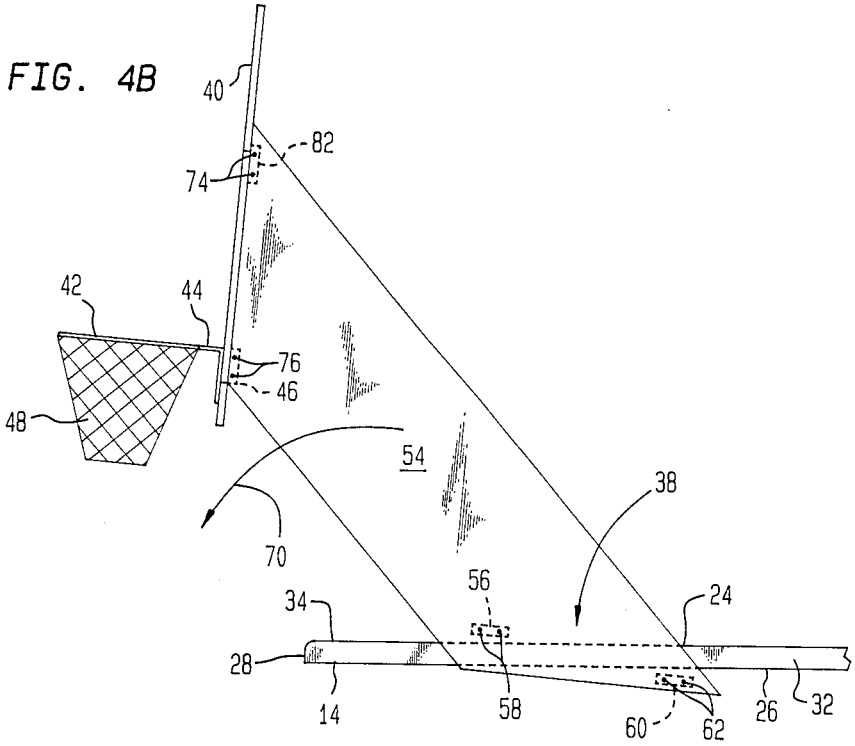

BASKETBALL BACKBOARD FOR A DIVING BOARD

BACKGROUND OF THE INVENTION

1. Field of the Invention

The invention relates to a basketball-like game apparatus attachable to the end of a diving board.

2. Description of Related Art

The game of basketball is well known and enjoyed widely. It is especially popular because it encourages and develops good hand/eye coordination. Swimming is also a popular sport which tends to encourage general overall development. As a result of the popularity of both basketball and swimming, several efforts have been made to combine the better features of both sports. Of some interest are the disclosures in U.S. Pat. Nos. 2,818,254; 3,743,286 and 4,307,880 which describe basketball-like games that are playable in a swimming pool. Similarly, U.S. Pat. Nos. 3,469,844 and 3,582,078 describe other water basketball-type games of possible interest. Lastly, U.S. Pat. No. 4,220,337 describes a ball game, not involving a basket, that can be played in a swimming pool.

SUMMARY OF THE INVENTION

Briefly described the invention comprises a backboard apparatus that is readily attachable to the end of a diving board overhanging the deep portion of a swimming pool. The game is played with a 5" ball which is meant to be shot through a hoop having a diameter of approximately 12". The hoop is mounted on a small scale backboard similar to a standard basketball backboard. The backboard is supported by a pair of vertical panels. A first horizontal member extends between the two panels at a location removed from the backboard and serves to support the bulk of the weight of the apparatus. The first horizontal member is adapted to rest on the top surface of the diving board. A second horizontal member also spans the two vertical panels and is located parallel to, but below the first horizontal member so as to engage the underside of the diving board. The center of gravity of the apparatus is located between the backboard and the first horizontal member so that the natural tendency of the device is to tilt, thereby forcing the second horizontal member into frictional engagement with the underside of the diving board. It is relatively easy to install the apparatus. The user merely has to guide the diving board between the first and second horizontal members. The first horizontal member rests on the top surface of the diving board. The apparatus is then tilted forward until the second horizontal member engages the bottom surface of the diving board. Optimally, the backboard overhangs the front of the diving board so that the backboard extends out over the deep portion of a swimming pool.

These and other features of the invention will be more fully understood by reference to the following drawings.

BRIEF DESCRIPTION OF THE DRAWINGS

FIG. 4A illustrates an initial step employed to install the game apparatus according to the preferred embodiment on a diving board.

FIG. 4B illustrates a subsequent step employed to install the preferred embodiment of the game apparatus on a diving board.

DETAILED DESCRIPTION OF THE INVENTION

Figure 1:
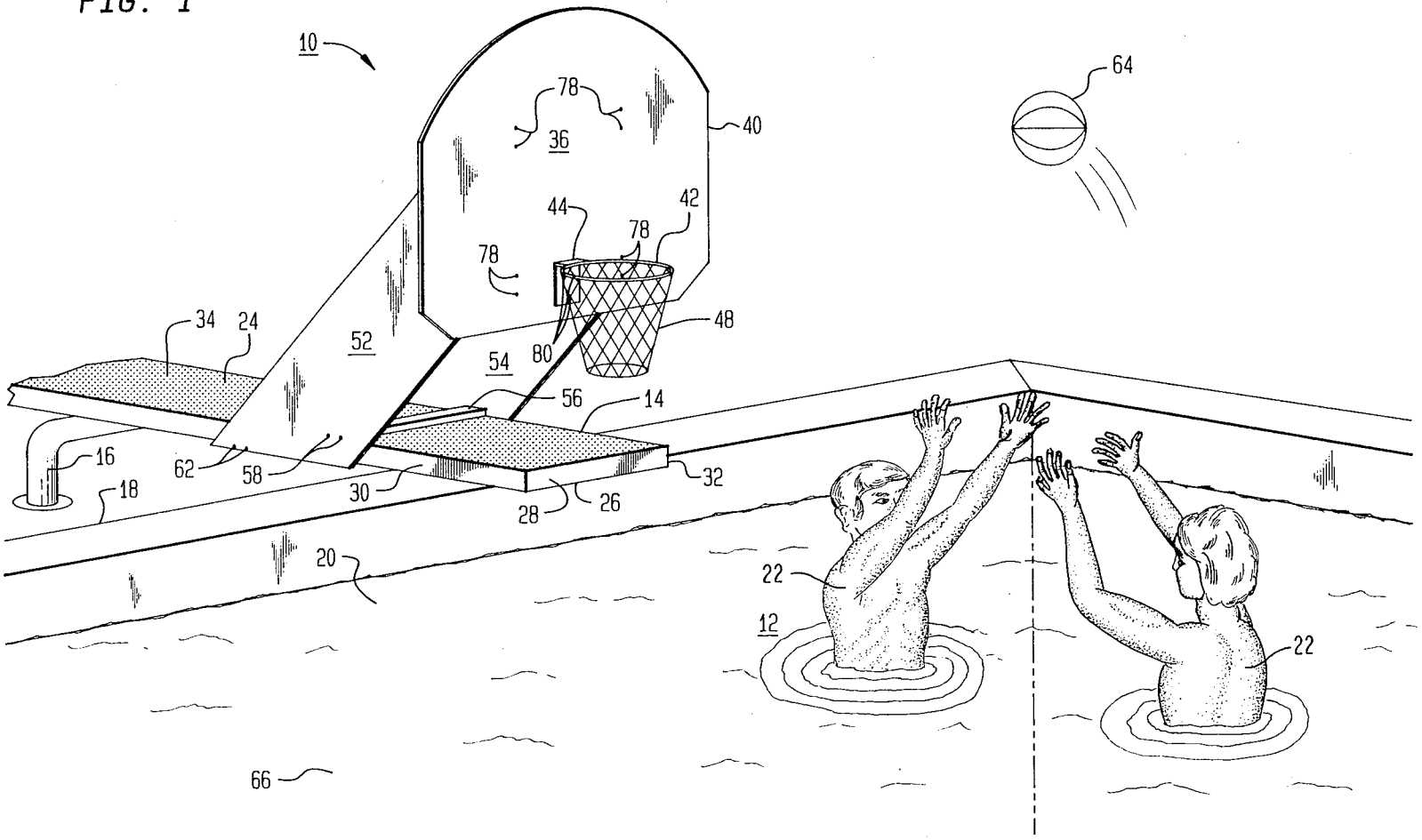
FIG. 1 is a perspective view of the game apparatus shown in the context of a swimming pool having a diving board.

During the course of this description like numbers will be used to identify like elements according to the different views that illustrate the invention.

The preferred embodiment of the invention 10 is illustrated in the context of a conventional swimming pool 12. A diving board 14 is supported by a conventional base 16 so that the front edge 28 thereof overhangs the deep end 66 of the pool 12. An edge 18 defines the periphery of pool 12. The swimmers 22 shown in water 20 are playing a basketball-like game with a 5" diameter ball 64. Ball 64 is small enough so that an individual swimmer 22 can grab it and throw it with one hand at target 36. Target 36 is a term generally used to describe backboard 40, hoop 42, bracket 44 and net 48. The diameter 50 of the hoop 42 is preferably 12" so as to accomodate the small 5" ball 64.

The diving board 14 is a conventional diving board having a top surface 24, a bottom surface 26, a front edge 28, a right side edge 30 and a left side edge 32. A conventional non-skid abrasive material 34 is preferably located on the top surface 24 and employed to keep divers from accidentally slipping off of the diving board 14.

Figure 2:
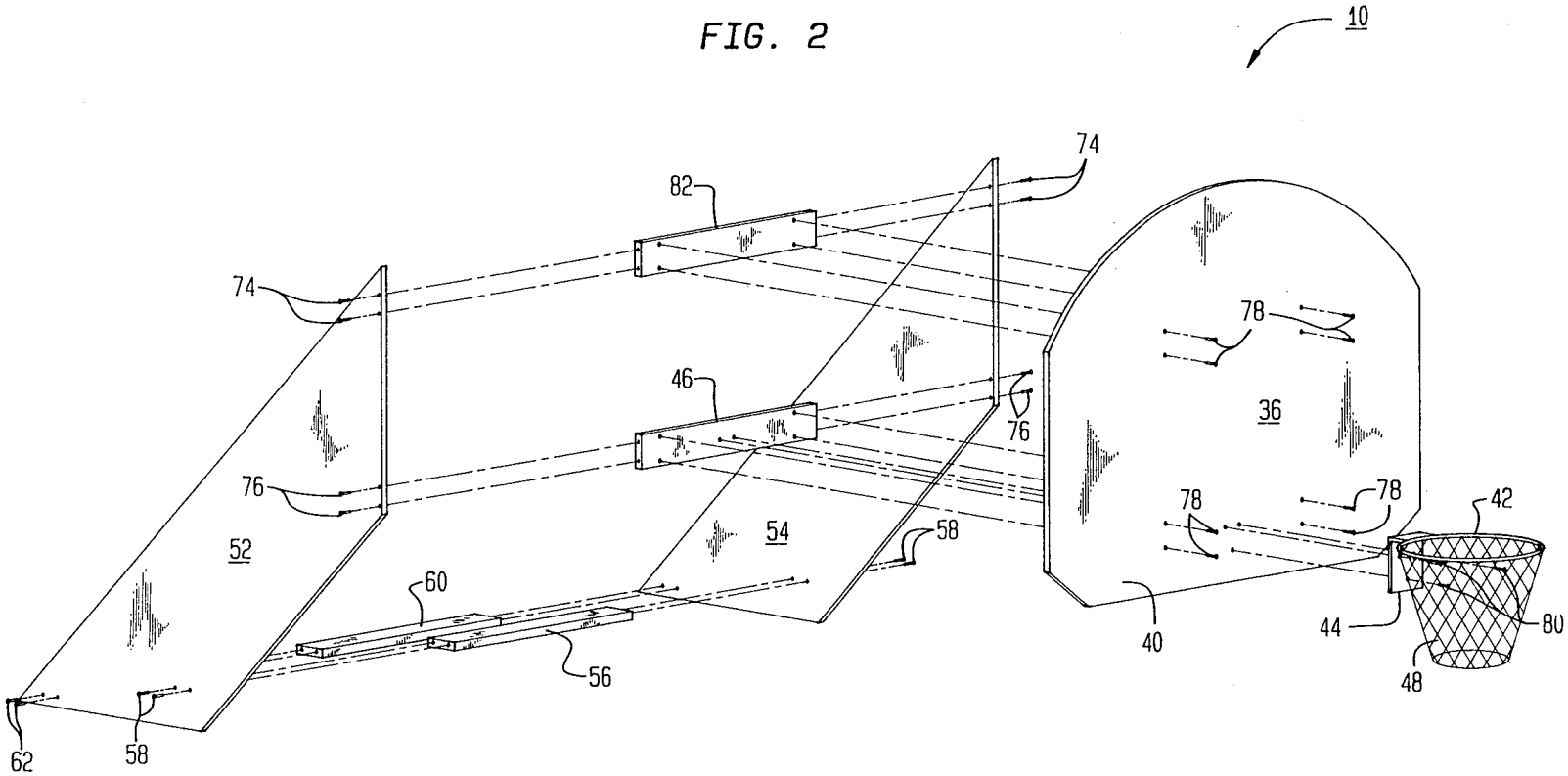
FIG. 2 is an exploded view of the preferred embodiment of the game apparatus.
Figure 3A:
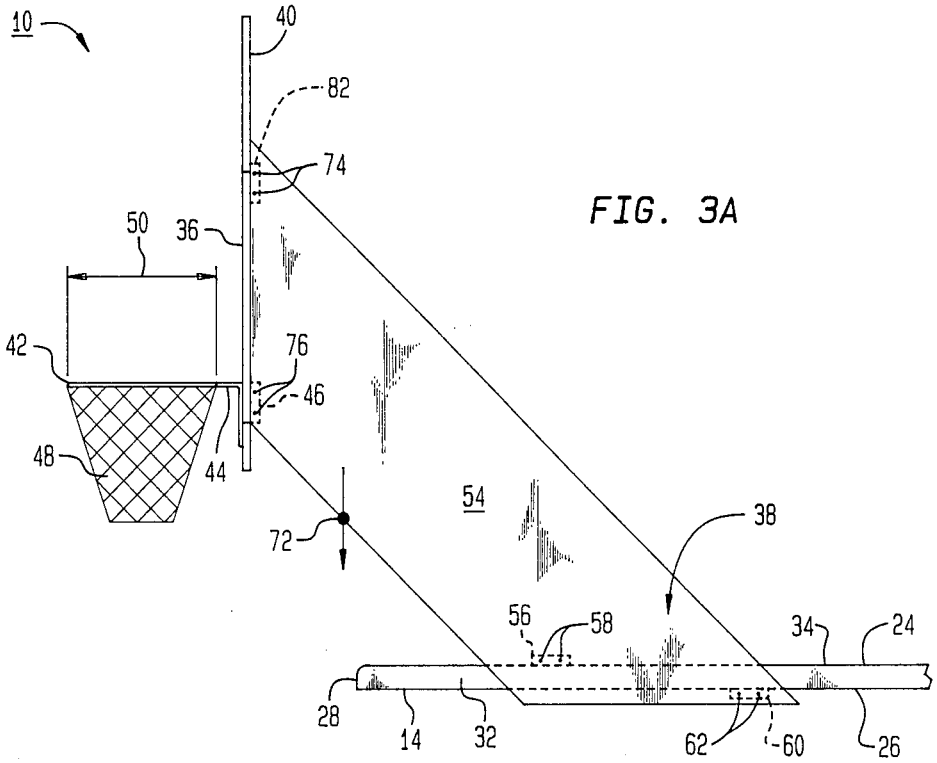
FIG. 3A is a left side elevational view of the preferred embodiment of the game apparatus.
Figure 3B:
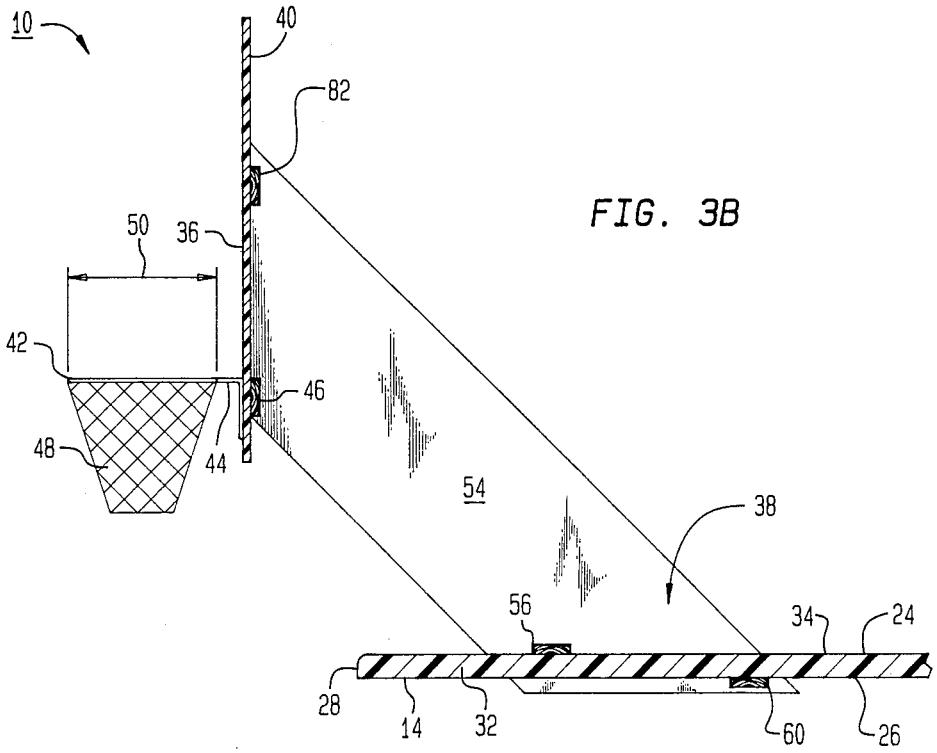
FIG. 3B is a cross-sectional view of the preferred embodiment illustrated in FIG. 3A showing the location of the center of gravity of the game apparatus.
Figure 3C:
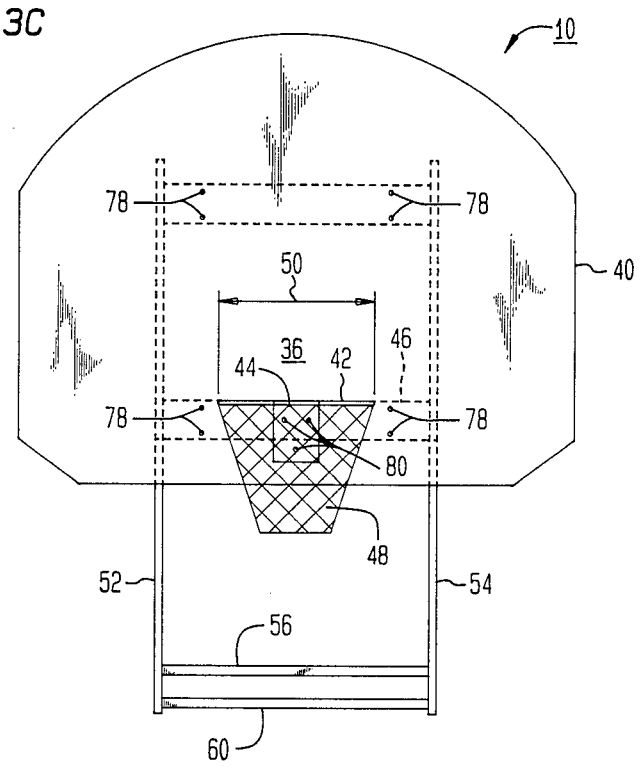
FIG. 3C is a front elevational view of the preferred embodiment of the game apparatus.
Figure 3D:
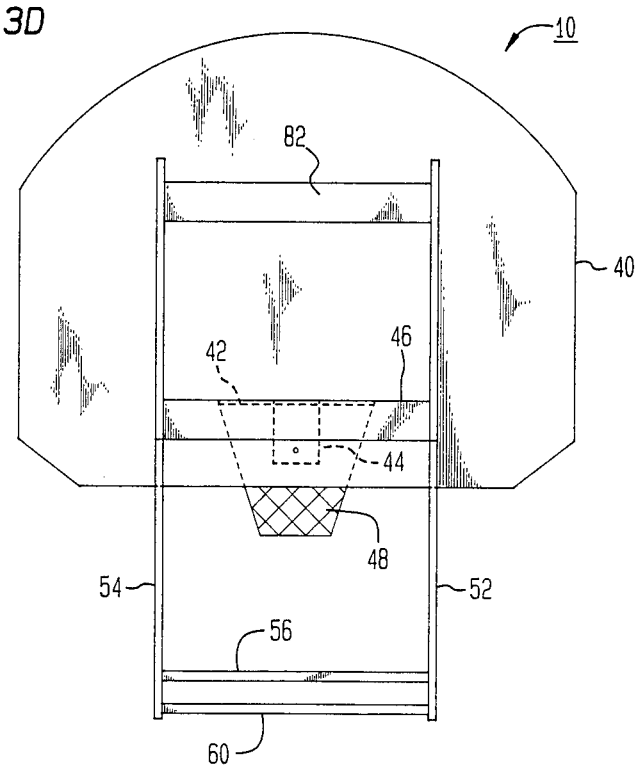
FIG. 3D is a rear elevational view of the preferred embodiment of the game apparatus.
Figure 3E:
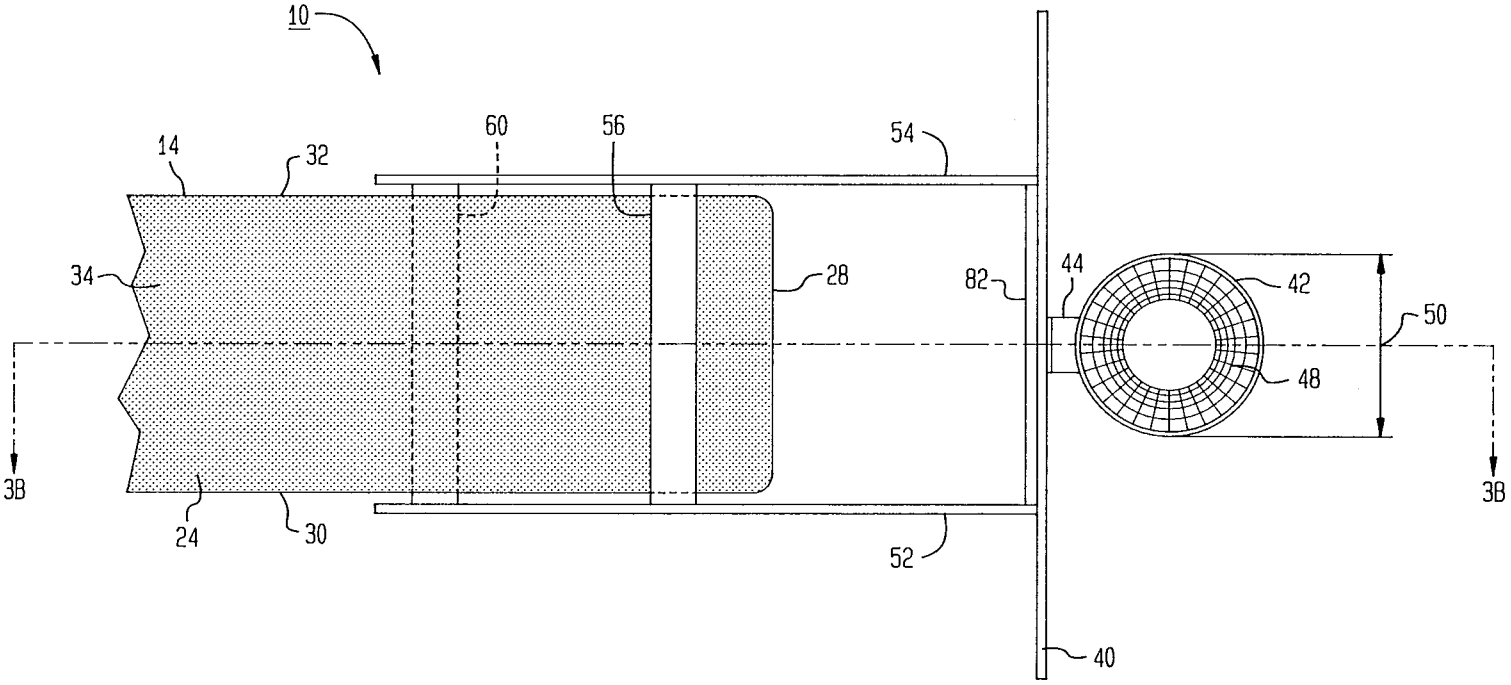
FIG. 3E is a top plan view of the preferred embodiment of the game apparatus.

Details of the invention 10 are best understood by referring to FIGS. 2 through 3E. In general the invention 10 can be considered to be a combination of a target 36 and an attaching means 38 for connecting it to a diving board 14. As previously described, the target 36 according to the preferred embodiment of the invention 10, includes backboard 40, hoop 42, bracket 44 and net 48. Bracket 44 is attached to backboard 40 by screws 80 which pass through the backboard 40 and into an anchor strip 46 located on the back of the backboard 40. Anchor strip 46 and horizontal brace member 82 are attached to backboard 40 by wood screws 78. Attaching means 38 preferably includes a right side panel 52, a left side panel 54, an upper horizontal member 56 extending between panels 52 and 54 and a lower horizontal member 60 located below and parallel to upper horizontal member 56 and also extending between panels 52 and 54. Screws 58 which pass through panels 52 and 54 are preferably used to attach the upper horizontal member 56 to panels 52 and 54. Similarly, a second set of screws 62 is used to attach the lower horizontal member 60 to panels 52 and 54. Wood screws 76 and 74 are employed to attach anchor strip 46 and brace member 82 respectively to vertical panels 52 and 54. Backboard 50, panels 52 and 54, upper horizontal member 56 and lower horizontal member 60 are all preferably formed from a plastic-like material. However, other materials such as water protected plywood would also be suitable. When installed on a diving board 14, the center of gravity 72 of the game apparatus 10 is preferably located between the downward projection of backboard 40 and the first upper horizontal member 56. This feature is important because it assists in the automatic stability of the apparatus.

The game apparatus 10 is installed on a diving board 14 in the manner illustrated in FIGS. 4A and 4B. Initially, the installer positions the apparatus 10 over the diving board 14 in the direction of arrow 68 so that the diving board 14 passes between the upper horizontal member 56 and the lower horizontal member 60. This brings left side panel 54 in close but not touching proximity to the left side edge 32 of the diving board 14. Similarly, right side panel 52 comes into close, but not touching proximity with the right side edge 30 of the diving board 14. The apparatus 10 is then permitted to drop softly until the upper horizontal member 56 come into engagement with the abrasive non-skid surface 34 of the top surface 24 of the diving board 14. In the next step, as shown in FIG. 4B, the game apparatus 10 is permitted to rotate in the direction of arrow 70 so that the lower horizontal member 60 comes into resting contact with the bottom surface 26 of the diving board 14. In this attitude the center of gravity 72 of the apparatus 10 creates a moment around the upper horizontal member 56 that forces the lower horizontal member 60 into frictional engagement with bottom surface 26. The game apparatus 10 thus installed, is quite secure against even relatively hard impact from ball 64.

The game apparatus 10 is easily removed by reversing the steps illustrated in FIG. 4A and 4B. Namely, the device is rotated in a clockwise direction opposite to the direction of arrow 70, until the lower horizontal member 60 disengages the bottom surface 26. The unit 10 is then lifted up slightly so that the upper horizontal member 56 disengages the top surface 26. Lastly, the unit 10 is moved forward in a direction opposite arrow 68 of FIG. 4A until the horizontal members 56 and 60 are free of the diving board 14. The entire apparatus 10 may then be removed to another location for temporary storage or may be knocked down by removing screws 58, 62, 74, 76, 78 and 80 so that the whole apparatus can be stored in a flat state.

The game apparatus 10 just described has several distinct advantages over prior art devices. First, it is relatively easy to manufacture. Second, it is easy to install and easy to remove. Third, it makes use of the deep end of the swimming pool so that swimmers have to use all of their swimming talents in order to play the game. Fourth, the apparatus is attachable to a diving board in an uncomplicated fashion so that the backboard 40 and hoop 42 extend out over the deep portion 66 of the water. Fifth, owing to its small scale it is possible to play the game with one hand. It would be very difficult to play in the deep water if the ball had to be manipulated with two hands.

While the invention has been described with reference to a preferred embodiment thereof, it will be appreciated by those of ordinary skill in the art that modifications can be made to the parts that comprise the invention without departing from the spirit and scope thereof.

We claim:

1. A method for connecting a game apparatus to a diving board, said game apparatus including a basketball-like backboard, a first and second panel connected to said backboard, and an upper and a lower horizontal member connected to said first and second panels respectively, said method comprising the steps of:

placing the end of said diving board between said first and second horizontal members;

resting the weight of said apparatus on said first horizontal member on said diving board; and, rotating said apparatus so that said second horizontal member contacts the underside of said diving board, wherein said apparatus is held in place by the downward action of the force of gravity tending to cause said apparatus to tilt forward and said second horizontal member to stay in contact with the bottom surface of said diving board.

2. A water game apparatus for use in a swimming pool having a diving board, said diving board having a top surface, a bottom surface, a first vertical edge and a second vertical edge, said water game apparatus comprising:

a target including a relatively flat basketball-like backboard and a hoop means attached to said basketball-like backboard;

first horizontal means locatable on the top surface of said diving board for supporting the bulk of the weight of said apparatus;

second horizontal means for keeping said apparatus from tipping over, said second horizontal means being locatable up against the bottom surface of said diving board when in use;

first vertical panel means attached to said first horizontal means, said second horizontal means and said basketball-like backboard and locatable along said first vertical edge of said diving board; and, second vertical panel means also attached to said first horizontal means, said second horizontal means and said basketball-like backboard and locatable along said second vertical edge of said diving board opposite from said first vertical edge of said diving board, wherein the center of gravity of said apparatus is located between said first horizontal means and said basketball-like backboard when said apparatus is properly attached to said diving board.

3. The apparatus of claim 2 wherein the diameter of said hoop is approximately 12".

4. A water game apparatus for use in a swimming pool having a diving board, said diving board having a top surface, a bottom surface, a first vertical edge and a second vertical edge, said water game apparatus comprising:

a target including a relatively flat basketball-like backboard and a hoop means attached to said basketball-like backboard;

first horizontal means locatable on the top surface of said diving board for supporting the bulk of the weight of said apparatus;

second horizontal means for keeping said apparatus from tipping over, said second horizontal means being locatable up against the bottom surface of said diving board;

first vertical means attached to said first horizontal means, said second horizontal means and said basketball-like backboard and locatable along said first vertical edge of said diving board; and, second vertical means also attached to said first horizontal means, said second horizontal means and said basketball-like backboard and locatable along said second vertical edge of said diving board opposite from said first vertical edge of said diving board, wherein the center of gravity of said apparatus is located forward of said first horizontal means in the direction of said basketball-like backboard when said apparatus is properly attached to said diving board.

* * * * *